United States Patent [19]

Magee

[11] 4,392,270

[45] Jul. 12, 1983

[54] SURFACE CLEANING APPARATUS

[75] Inventor: S. Jim Magee, Coquitlam, Canada

[73] Assignee: Magee Enterprises Ltd., Coquitlam, Canada

[21] Appl. No.: 262,255

[22] Filed: May 11, 1981

[30] Foreign Application Priority Data

Jun. 9, 1980 [CA] Canada ..... 353588

[51] Int. Cl.[3] ..... E01H 1/08; E01H 1/10

[52] U.S. Cl. ..... 15/322; 239/556

[58] Field of Search ..... 15/320, 321, 322, 345, 15/346; 239/286, 287, 556, 557

[56] References Cited

U.S. PATENT DOCUMENTS

| | | | |
|---|---|---|---|
| 2,909,800 | 10/1959 | Grindle et al. | 15/321 |
| 3,423,027 | 1/1969 | Small et al. | 239/287 |
| 3,439,374 | 4/1969 | Wisdom | 15/321 |
| 3,447,188 | 6/1969 | Maasberg | 15/346 X |
| 3,871,051 | 3/1975 | Collier | 15/321 |
| 3,909,197 | 9/1975 | Cremers | 15/321 X |
| 3,987,964 | 10/1976 | Pittman et al. | 239/287 X |
| 4,137,600 | 2/1979 | Albishausen | 15/322 |
| 4,164,055 | 8/1979 | Townsend | 15/321 |
| 4,168,562 | 9/1979 | Maasberg | 15/322 X |

FOREIGN PATENT DOCUMENTS

| | | | |
|---|---|---|---|
| 584806 | 10/1959 | United Kingdom | 15/321 |

*Primary Examiner*—Chris K. Moore

*Attorney, Agent, or Firm*—Alan H. Levine

[57] ABSTRACT

An improved apparatus for cleaning roofs and other surfaces having both coarse and fine compacted particulate matter to be cleaned. A spray of water under pressure of 1,000 to 2,000 psi is applied from the inside of an open bottommed vacuum chamber toward the surface to be cleaned along a line at an angle across the chamber, to dislodge fine and/or coarse residue from the surface. A second spray is immediately applied following the first before the residue resettles on the surface, while at the same time a vacuum is applied to the chamber to remove the deflected spray and residue.

16 Claims, 6 Drawing Figures

SURFACE CLEANING APPARATUS

This invention relates to a surface cleaning apparatus, and particularly to apparatus useful for cleaning roofs.

BACKGROUND OF THE INVENTION

Roofing materials usually contain a surface coating of base material, covered by coarse protective particulate matter such as gravel. In time, a thick coating of dust (often ½ inch or more in thickness) builds up and must be removed when the roof is cleaned.

Repair of roofs often involves resaturation or recoating of the base material, and the residual dust reduces the penetrating qualities of the resaturant or coating before reaching the roof mat for which it is intended. Since hot applications cure rapidly on contact with cool roof surfaces, the hot material cures on top of the dust if the roof mat is not properly cleaned. The dust also absorbs the resaturant material, reducing or inhibiting the ability of the resaturant to saturate the roof mat. Clearly careful and thorough cleaning is essential.

One traditional way of cleaning a roof is to hand brush the edges of confined areas, power sweep the roof, remove and dispose of the roof debris, power sweep again to remove the fine dust materials (fines), remove and dispose of the fines, and finally blow the roof area to remove residual fines. Sometimes a third power sweep is required. This technique often produces clouds of blowing residue, which pollutes the atmosphere and usually resettles on the roof.

A more recent approach to cleaning roofs is to rough clean or remove the loose gravel and debris from the roof area to be upgraded or repaired, and then power sweep to loosen the fine dust that has been packed on the roof mat over the years. Finally the roof is vacuumed to pick up the loosened fine dust. The vacuum system safely confines and contains fine dust and other pollutants before they are released into the atmosphere.

However it has been found that when the roof is wet, the fines are solid and require extensive agitation to loosen, but still cannot be picked up by the vacuum unit before resettling.

SUMMARY OF THE INVENTION

The present invention is a surface or roof cleaning apparatus which can be used successfully with both dry and wet fines. The present invention both agitates and vacuums up the residue, including gravel and dust at the same time. Accordingly the fines have no chance to resettle, and a substantially improved roof cleaning system results, which is less time consuming and more efficient than previous systems.

The surface cleaning apparatus of the present invention utilizes a powered water-jet spray against the roof but contained within a vacuum chamber, the quantity and pressure of the water being balanced against the vacuum in the chamber. The angles and spacing of the jets at the roof surface are precisely located for efficient operation. The course materials and fines which are loosened are vacuumed off the roof, into a confined chamber, and carried via a vacuum hose to a residue dump. It should be noted that the water or other fluid pressures used are in the range of 1,000–1,2000 pounds per square inch, typically 1500 pounds per square inch.

The surface cleaning apparatus of the invention is comprised of, in general, a vacuum chamber having an open bottom and an upper vacuum exhaust port, and liquid jet spray apparatus mounted within the chamber above the bottom thereof, the angle of spray of the spray apparatus being such as to direct spray liquid downward at a predetermined angle between the front and rear of the chamber along the width of the chamber.

According to a preferred embodiment of the invention, the spray apparatus is comprised of a plurality of jet spray tips mounted along the front and rear of the vacuum chamber. The emission axes of the front and rear spray tips are directed downward toward a central line between the front and rear of the chamber at alternating at angles of 20½ and 14½ degrees to the vertical, the front and rear spray tips being separated by about 2 inches and located about 2 inches above the bottom front of the vacuum chamber. The spray pattern of each tip is fan shape, and each in a row of tips substantially abuts to form 2 spray lines across the vacuum chamber. The spray pattern is such that there is substantially no interference therebetween, whereby two individual roof washes are obtained, and the deflected spray and residue is vacuumed into the vacuum chamber.

While the present invention is particularly useful for cleaning roofs, it is intended that it can also be used in other cleaning applications.

BRIEF INTRODUCTION TO THE DRAWINGS

A better understanding of the invention will be obtained by reference to the detailed description below of the preferred embodiment of the invention, with reference to the following drawings, in which:

FIG. 1 is a side view of the cleaning apparatus, showing internal structure, FIG. 2 is a front view of the surface cleaning apparatus, FIG. 3A is a front view of a pipe used in the invention for carrying the nozzles, FIG. 3B is a section through the pipe of FIG. 3 showing detail thereof, and FIGS. 4A and 4B are front elevation and plan views of the preferred spray pattern respectively.

DETAILED DESCRIPTION OF THE INVENTION

Figure 1:
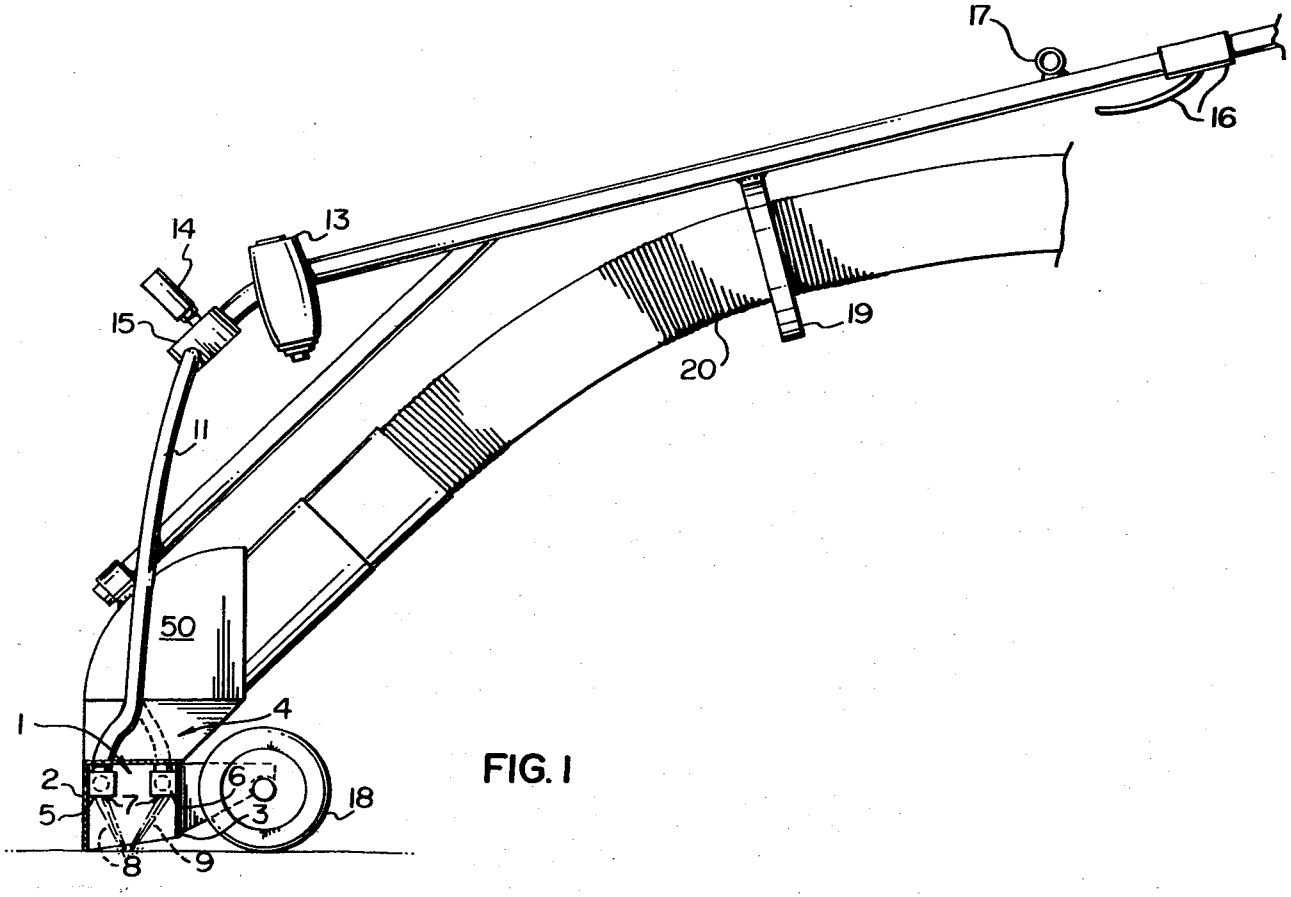
Figure 2:
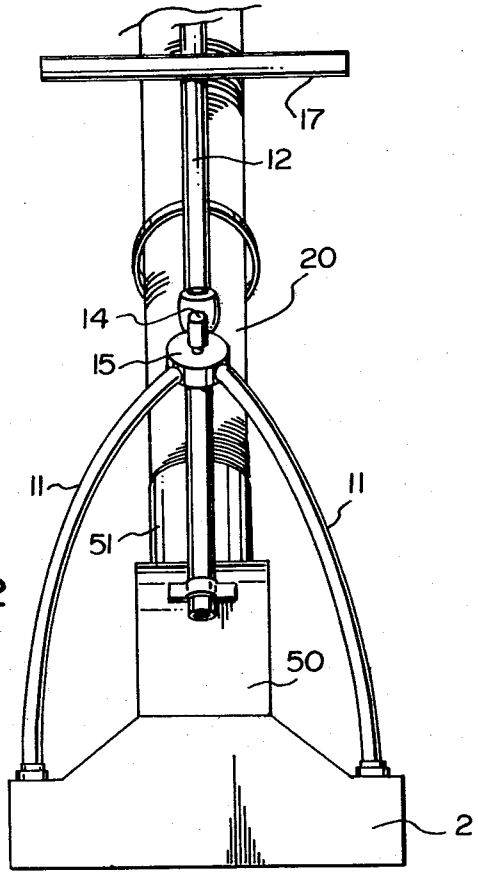

Turning first to FIGS. 1 and 2, the preferred embodiment of the invention is comprised of a vacuum chamber 1 in a housing having a front wall 2, side walls, and a rear wall 3. The vacuum chamber is open at the bottom and a has a vacuum exit port 4 at its top. A vacuum passage 50 connects a cylinder 51 for connection of a vacuum hose to exit port 4.

Along the front and rear of the vacuum chamber are fixed a front pipe 5 and rear pipe 6, which are adapted to retain jet spray tips or nozzles 7, and spray water (or other liquid as desired) delivered by the pipes.

It is preferred that the jet spray tips should spray fan-shaped patterns having 90° divergence and should be located 2 inches above the bottom of the vacuum housing, each separated by 3 5/16 inches. The front and rear rows of spray tips preferably are separated by about 2 inches. The spray tips should be angled toward a strip running across the center of the vacuum chamber, below the vacuum chamber. The alternate spray tips in a row are preferably angled at 20½ and 14½ degrees from the vertical respectively, for reasons which will be explained below.

Figure 4A:
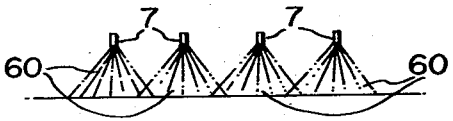
Figure 4B:
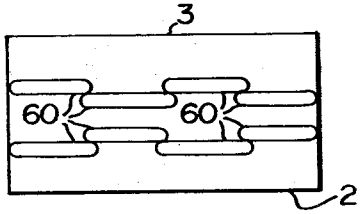

Turning for a moment to FIGS. 4A and 4B, an elevation and plan view of the spray patterns are shown. The spray tips 7 emit 90° fan-shaped spray patterns 60, and while they appear to overlap in FIG. 4A, actually do not since the angle of each alternate spray tip is 14½ and 20½ degrees. The resulting spray pattern on the surface to be cleaned is non-overlapping and continuous from one side of the vacuum housing to the other, as may be seen in FIG. 4B. If the height of the spray tips were greater, given the number used across the vacuum chamber housing, the sprays would overlap, cancelling the powerful scouring action where they overlap. Further, if the spray tips were all at the same angle to the vertical, raising the housing slightly from the roof to facilitate movement would result in interference of the sprays at their adjacent edges, again cancelling the effects at their adjacent edges, and leaving gaps in the scouring. The alternating spray tip angles provide freedom to raise the bottom of the housing up to about ¾ inches from the surface to be cleaned, resulting in the slight spreading of each fan area on the surface, before interference is encountered, yet maintaining a close to optimum spray axis attack angle on the surface to be cleaned.

Preferably the fluid pressure used should be in the range of 1,000–2,000 pounds per square inch, and the residual back pressure, spray and residue balanced by the vacuum pressure applied to the vacuum chamber. Typically the fluid pressure should be about 1,500 pounds per square inch, and the vacuum about 24 inches of mercury.

The pipes 5 and 6 are connected via high pressure hoses 11 to a fluid supply pipe 12. A stainless steel pressure filter 13 having a 200 mesh screen is inserted in series with the pipe, and a pressure gauge 14 is connected to pipe 12 and hoses 11 at a stainless steel manifold 15. Also connected in series with pipe 12 is a triggered grip 16 which, when closed, allows water under high pressure to be applied to pipe 12.

A T-bar grip 17 can also be used as desired for convenient handling of the apparatus.

A pair of wheels 18 are rotatably fixed to opposite sides of the rear of the vacuum chamber housing, to facilitate forward and rearward rolling of the structure. The bottom of the wheels should be level with the bottom of the front of the vacuum chamber housing.

It is preferred that the rear wall of the housing should be higher than the front as shown in FIG. 1, e.g. ⅛ inch, the bottom of front wall 2 defining the bottom of the vacuum chamber. In this manner the ingress of air is facilitated when the apparatus is dragged backward along a surface.

It is also preferred that a vacuum hose retainer 19 in the form of a metal loop should be fixed to the underside of fluid supply pipe 12 to restrain a vacuum hose 20 which is fixed to the vacuum inlet 50 when the apparatus is in use.

Figure 3A:
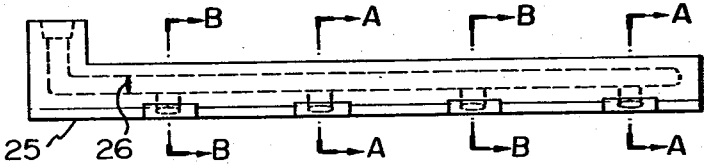
Figure 3B:
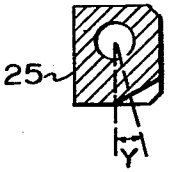

Turning now to FIGS. 3 and 3A, a detail of the pipes 5 and 6 is shown in section. The pipe (referenced 25) preferably has a rectangular cross-section, and has an internal bore 26 of, for example ½ inch. One end of the pipe is closed, and the other terminates at a right angle to receive a high pressure water inlet pipe.

Pipe 25 is bored at 3 5/16th inch intervals at the locations shown by sections B-B and A-A, and tapped to accept jet spray nozzles. The nozzles are commercially available and one type which was successfully used is type H1/4VVSS800015, from Spray Systems Ltd.

The angle Y of the nozzle bore is preferably 20½ degrees at the A-A cross-sections, and 14½ degrees at the B-B cross-section positions.

With one of pipe 25 disposed at the position of pipe 5 at the front of the vacuum chamber as shown, with its inlet at one side, and with another located along the rear of the vacuum chamber with its inlet at the opposite side, alternate nozzles in a row are slightly staggered from each other but result in two separately continuous spray patterns across the inside of the vacuum housing. As noted earlier, it is important that the spray patterns should not overlap, since the sprays would interfere and cancel. The result is a highly efficient double-wash, one from the front row of nozzles and from the rear row of nozzles, both attacking the surface to be cleaned at preferred angles, the deflected fluid and residue being vacuumed up in the vacuum chamber.

In a further preferred embodiment of the invention, the angle of the front row of nozzles can be made greater than the rear row. This allows the vacuum housing to be lifted slightly and rotated around wheel 18 in order that the resulting spray angle against the roof surface from both sets of spray nozzles should be exactly the same. Preferably the angle with the vertical when in use is about 17½ degrees. However, satisfactory results have been found with the spray angles described earlier.

To facilitate lifting of the housing to locate the bottom evenly spaced from the surface to be cleaned, the rear wall of the vacuum chamber is raised ⅛ inch, and the bottom of the sides are aligned with the front and rear edges.

In operation a fluid such as water is applied at high pressure such as 1,500 pounds per square inch to pipe 12 when the grip 16 trigger is open. Vacuum at, for example, 24 inches of mercury is applied to vacuum inlet 50. The apparatus is tilted back about wheels 18 until the bottom edges of the vacuum chamber are about ¾ inches from the roof. The entire apparatus is pushed forward along the roof. Alternatively the apparatus is pulled along the roof, the lower wall edge dragging.

Water is forced out of nozzles 7 at high pressure, scouring the surface first with the front spray pattern and then the rear. Typically up to 7 gallons per minute of the fluid will wash the surface of the roof in the two non-overlapping washes, each attacking the roof at about similar angles. Both large and fine particulate matter is thus very efficiently dislodged and carried via the vacuum hose 20 to a dump site (not shown).

It should be noted that by enclosing a turbine or flutter valve in the water spray pipe, a pulsating spray is produced, which increases further the scouring and resulting efficiency of the apparatus.

By locating a powerful jet spray inside the vacuum chamber, both a wash and vacuuming a roof residue including both coarse and fine material, both wet and dry, is provided. Air pollution and resettling of fines is substantially avoided. Further, with the preferred angles and dimensions given, a substantially improved and more efficient cleaning of roofs, concrete floors and other surfaces is obtained, with reduced labour.

A person skilled in the art understanding this invention may now conceive of other emobodiments or variations thereof. All are considered within the sphere and scope of this invention as defined in the claims appended hereto.

What is claimed is:

1. A surface clearing apparatus comprising a vacuum chamber having an open bottom and an upper exhaust port, and high pressure liquid jet spraying means mounted within the chamber a predetermined height above the bottom thereof, the spraying means being comprised of a plurality of high pressure spray heads mounted along one of the front or rear of the vacuum chamber each adapted to emit a fan shaped spray at an angle toward the surface to be cleaned and being directed away from the adjacent front or rear of the chamber coextensive and noninterfering with the spray from an adjacent spray head, so as to form a substantially ungapped transverse line across the chamber along said surface.

2. A surface cleaning apparatus as defined in claim 1, in which the spraying means is comprised of a further plurality of spray heads mounted along the other of the front or rear of the vacuum chamber, each adapted to emit a fan shaped array toward the surface to be cleaned and at an angle inwardly of the chamber coextensive and noninterfering with the spray from an adjacent spray head, so as to form a second ungapped transverse line across the chamber along said surface.

3. A surface cleaning apparatus as defined in claim 2, in which the spraying means includes a pair of water supply pipes, one mounted along the front and one mounted along the rear of the vacuum chamber, said pluralities of jet spray nozzles spaced along and communicating with said pipes for receiving said water under pressure, the spray angles of the nozzles being such as to focus the axes of liquid emissions therefrom generally toward the center of the chamber along lines the width of the chamber at a predetermined distance below the bottom of the vacuum chamber.

4. A surface cleaning apparatus comprising a vacuum chamber having an open bottom and an upper exhaust port, liquid jet spraying means mounted within the chamber including a first plurality of jet spray nozzles spaced in a line along the inside of the front of the housing, each having a fan shaped spray pattern with a 90 degree divergence, the pattern being coextensive and noninterfering, the nozzles each being located 2 inches above the bottom of the housing and spaced 3 5/16 inches apart, and water supply means connected to said nozzles for supplying water thereto under pressure.

5. A surface cleaning apparatus comprising a vacuum chamber having an open bottom and an upper exhaust port, and liquid jet spraying means mounted within the chamber, including a first plurality of jet spray nozzles spaced along the inside of the housing, each having a fan shaped spray pattern, the height, spacing and angle of spray of the nozzles being predetermined so as to substantially avoid interference of the spray between each of the nozzles, yet to spray a substantially continuous line from one side of the chamber to the other at an angle to the vertical in a plane at a working level at or below the bottom of the housing, and means for supplying water under pressure thereto.

6. A surface cleaning apparatus as defined in claim 5, in which the divergence of the spray from each nozzle is about 90 degrees, the nozzles are located 2 inches above the bottom of the housing, are spaced 3 5/16 inches apart, and the axes of alternate nozzles are at angles of about 14 ½ and 20 ½ degrees respectively from the vertical inwardly of the chamber.

7. A surface cleaning apparatus as defined in claim 6, in which the first plurality of nozzles is located along the inside front of the housing, and the spraying means further includes a second plurality of jet spray nozzles similar to said first plurality of nozzles spaced along the inside rear of the housing at least 2 inches from said first plurality of nozzles, the height, spacing and angle of spray thereof being similar to the first plurality of nozzles, the first and second plurality of nozzles directing their sprays in a direction generally downward and inward below the bottom of the housing.

8. A surface cleaning apparatus as defined in claim 7, in which the rear of the bottom of the vacuum chamber is raised relative to the front.

9. A surface cleaning apparatus as defined in claim 8, further including a pair of wheels mounted for support of the vacuum chamber and to facilitate forward and rearward movement thereof, the bottom of the wheels being at the same level as the front of the vacuum chamber.

10. A surface cleaning apparatus as defined in claim 7, in which the bottom of the vacuum chamber is truncated, the front edge thereof being lower than the rear.

11. A surface cleaning apparatus as defined in claim 9 or 10, in which the front is ⅛ inches lower than the rear.

12. A surface cleaning apparatus as defined in claim 1, 6 or 9 including means for applying liquid to be sprayed to the spray means at a predetermined pressure, and means for applying vacuum to the exhaust port at a pressure sufficient to balance the pressure of the liquid.

13. A surface cleaning apparatus as defined in claim 1, 7 or 9 including means for applying pulsations of liquid to be sprayed to the spray means, and means for applying vacuum to the exhaust port at a pressure sufficient to balance the pressure of the liquid.

14. A surface cleaning apparatus as defined in claim 1, 7 or 9, including means for applying liquid to be sprayed to the spraying means at a pressure in the range of about 1,000 to 2,000 psi, and means for applying vacuum to the exhaust port at a pressure sufficient to balance the pressure of the liquid.

15. A surface cleaning apparatus as defined in claim 1, 7 or 9, including means for applying liquid to be sprayed to the spraying means at a pressure of about 1,500 psi, and means for applying vacuum to the exhaust port at a pressure sufficient to balance the pressure of the liquid.

16. A surface cleaning apparatus comprising:

(a) a vacuum chamber having an open truncated bottom and an upper exhaust port, the front of the bottom being lower than the rear, (b) a plurality of jet spray tips mounted in opposed pairs along the front and rear of the chamber, the emission axes of alternate spray tips being directed downwardly and inwardly at angles of 14½ and 20½ degrees, the spray tips at the front and rear being separated by about 2 inches and located about 2 inches above the bottom front of the vacuum chamber, (c) means for applying vacuum to the exhaust port, and (d) means for applying water at a high pressure to the nozzles, the vacuum pressure being sufficient to balance against the quantity and pressure of the water.

* * * * *